United States Patent [19]

Naito

[11] 4,185,573

[45] Jan. 29, 1980

[54] SEWING MACHINE

[75] Inventor: Hajime Naito, Kofu, Japan

[73] Assignee: Crystal Sewing Machine Ind. Co., Ltd., Yamanashi Pref., Japan

[21] Appl. No.: 853,233

[22] Filed: Nov. 17, 1977

[30] Foreign Application Priority Data

Jul. 1, 1977 [JP] Japan ..... 52/77750
Jul. 1, 1977 [JP] Japan ..... 52/86202[U]

[51] Int. Cl.[2] ..... D05B 57/30; D05B 61/00

[52] U.S. Cl. ..... 112/183; 112/184; 112/231

[58] Field of Search ..... 112/183, 184, 192, 193, 112/231

[56] References Cited

U.S. PATENT DOCUMENTS

| | | | |
|---|---|---|---|
| 10,125 | 5/1882 | Hurtu et al. | 112/183 X |
| 328,089 | 10/1885 | Valentine | 112/192 |
| 432,957 | 7/1890 | Squire | 112/192 |
| 2,299,524 | 10/1942 | Chason | 112/231 |
| 3,390,653 | 7/1968 | Ketterer | 112/184 X |

*Primary Examiner*—Wm. Carter Reynolds
*Attorney, Agent, or Firm*—James E. Nilles

[57] ABSTRACT

A sewing machine having a semi-rotating looper assembly, characterized in that the driving mechanism for said semi-rotating looper assembly comprises a motor, a rotatable link, and a sector gear formed on said rotatable link. Said sewing machine further comprises a cloth-feeding mechanism including cloth-feeding teeth, a spring for biasing said cloth-feeding teeth in one direction and to a level below the plane of the cloth to be fed, and a swingable lever connected to said link. Said semi-rotating looper assembly includes a rotating looper holder opening in the table surface of the machine body, a slit formed in the inner peripheral wall of said rotating looper holder, and a rotating looper disposed in said rotating looper holder and having a bobbin holding portion and an edge. Said looper assembly further includes a driving mechanism for causing a partial reciprocatory rotary motion of said rotating looper within said rotating looper holder. Said looper assembly also includes an entanglement preventing member mounted on the machine body and having an end extending through said slit into said rotating looper holder for a resilient contact with the outer peripheral wall of said rotating looper.

1 Claim, 15 Drawing Figures

SEWING MACHINE

The present invention relates to a sewing machine and, more particularly, to a sewing machine having a horizontal semi-rotating looper mechanism.

Conventional sewing machines employ a driving mechanism for a rotating looper assembly and a cloth-feeding mechanism, which are both complicated in structure and difficult to manufacture. Further, these mechanisms can hardly be repaired in case of failures or troubles, and are generally expensive.

Under these circumstances, the present invention aims at providing a simplified sewing machine having a simplified horizontal rotating looper assembly and its driving mechanism.

It is another object of the invention to provide a simplified sewing machine having a simple cloth-feeding mechanism.

It is still another object of the invention to provide a simplified sewing machine in which the driving mechanism for the rotating looper assembly and the cloth-feeding mechanism are driven by a common driving source.

These and other objects, as well as advantageous features of the invention will become clear from the following description of the preferred embodiments taken in conjunction with the attached drawings.

Figure 1:
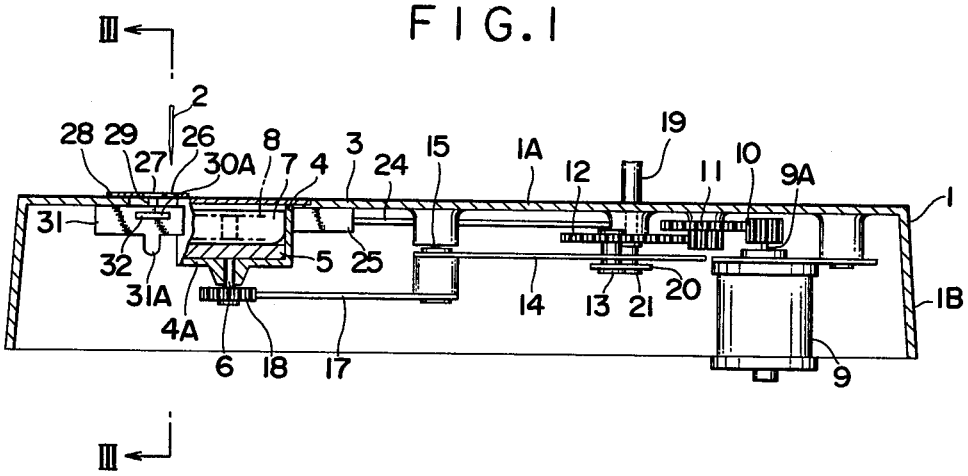
Figure 2:
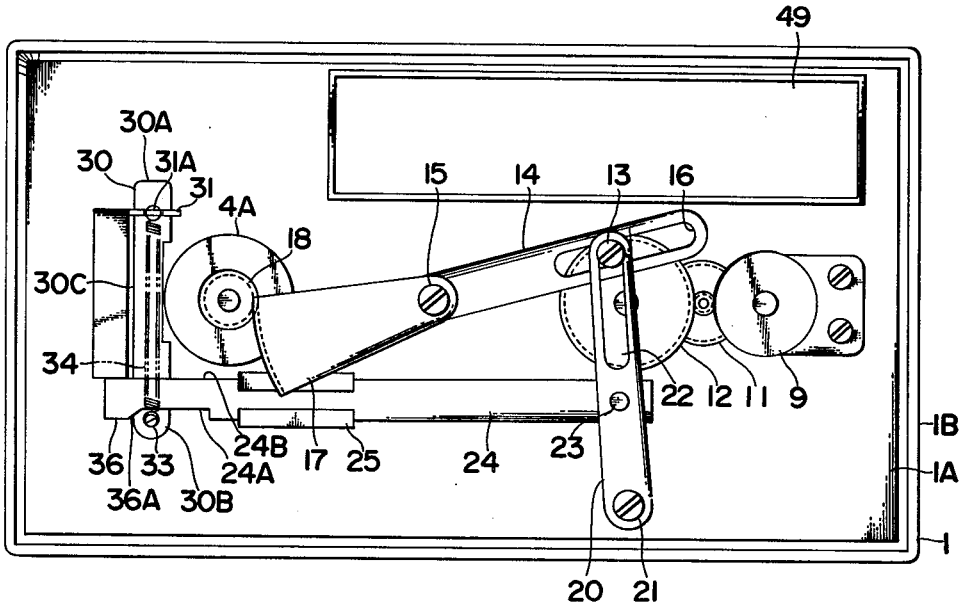
Figure 3:
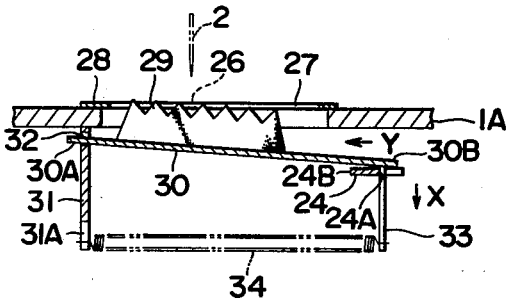
Figure 7:
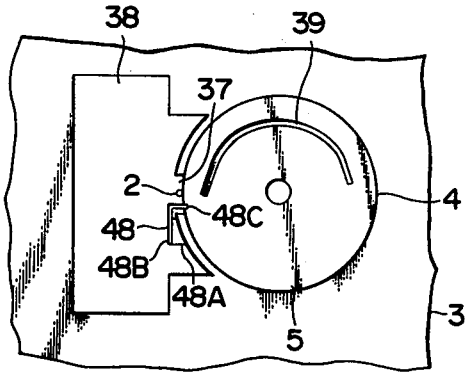
Figure 8:
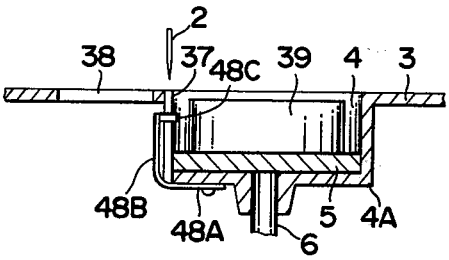
Figure 4B:
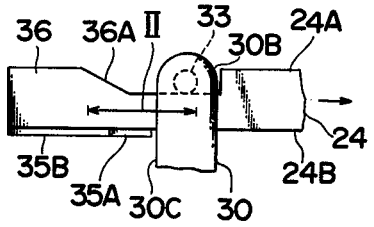
Figure 4A:
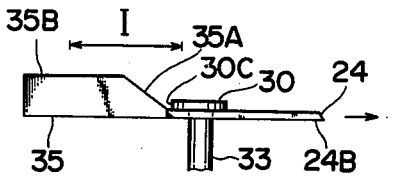
Figure 5B:
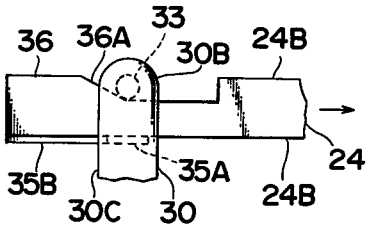
Figure 5A:
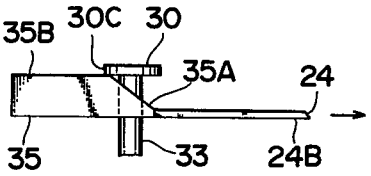
Figure 6B:
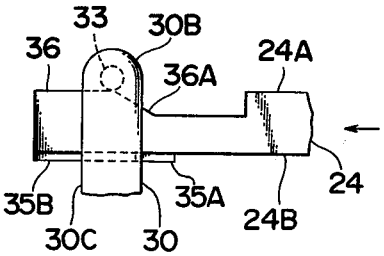
Figure 6A:
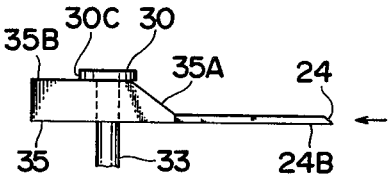
Figure 10:
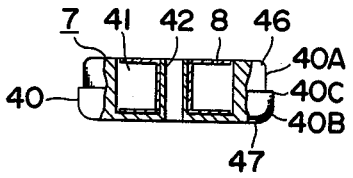
Figure 9:
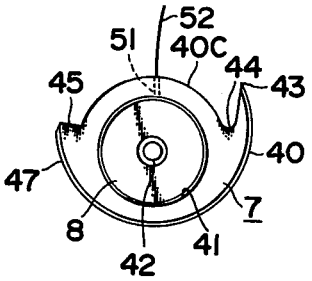
Figure 12:
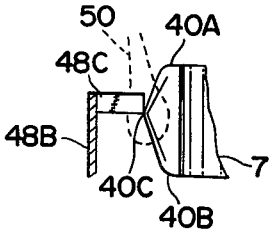
Figure 11:
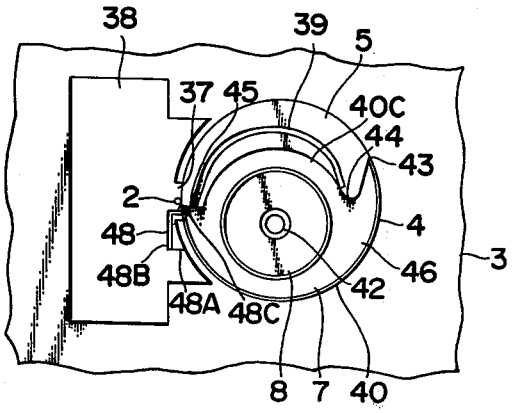

FIGS. 1 and 2 are a sectional front elevational view and a bottom plan view of essential parts of a sewing machine embodying the present invention, FIG. 3 is a sectional view taken along the line III—III of FIG. 1, and showing a cloth-feeding mechanism, FIGS. 4A, 4B, FIGS. 5A, 5B and 6A, 6B inclusive are illustrations of sequential operation of a base plate for cloth-feeding teeth, caused by an arm plate, in which FIGS. 4A, 5A and 6A are views from the front side of the arm plate, while FIGS. 4B, 5B and 6B are plan views, FIGS. 7 and 8 are plan and sectional views for explaining a rotating looper driving plate and a rotating looper holder of a sewing machine in accordance with the invention, FIGS. 9 and 10 are a plan view and a partially sectioned front elevational view of a rotating looper and a bobbin of a rotating looper assembly in accordance with the invention, FIG. 11 is a plan view of a rotating looper assembly in accordance with the invention, and FIG. 12 is an illustration of a member for preventing thread-entanglement.

Referring to the drawings, an outer casing or housing 1 of a sewing machine consists of an upper wall 1A and a peripheral wall 1B which are made of, for example, a plastic.

Although omitted from the drawings, a mechanism for driving a needle 2 reciprocatorily up and down, a cover for the mechanism, an upper thread feeding mechanism, a cloth retaining mechanism, a lower thread taking up mechanism and so on are mounted on the upper wall 1A of the housing 1.

As shown in FIG. 1, a table 3 on which a cloth to be sewed is placed is formed on the upper wall 1A of the housing 1.

A horizontal semi-rotating looper mechanism is provided in the sewing machine embodying the present invention. More specifically, as shown in FIG. 1, a rotating looper holder 4 is formed by a circular recess which opens in the upper wall 1A of the housing 1, in the vicinity of the passage of the needle 2. A driving plate 5 for a rotating looper is housed by the rotating looper holder 4, for free rotation within a horizontal plane. A driving shaft 6 for the rotating looper passes through the bottom wall 4A of the rotating looper holder 4, and is connected at its top end to the driving plate 5. The rotating looper 7 carried by its driving plate 5 is also housed by the rotating looper holder 4, and carries at its bottom surface a bobbin 8 for the lower thread. The rotating looper 7 is adapted to be rotated by means of a driving plate formed on the driving plate 5.

As will be seen from FIGS. 1 and 2, a motor 9 is fixed to the lower side of the upper wall 1A of the housing 1. The motor 9 has a shaft 9A to which secured is a small gear 10 which engages, through the medium of a reduction gear 11, a gear or rotary plate 12. The gear 12 has a projection 13 which projects from the lower side thereof, at a radially outer side of the same.

A rotatable link 14 is pivotally secured at its one end portion, by means of a pivot shaft 15, to the lower side of the upper wall of the housing. An elongated slot 16 formed in the other end of the link 14 slidably receives the projection 13, while the one end of the link 14 carries a sector gear 17 which engages a gear 18 fixed to the shaft 6 for driving the rotating looper.

The eccentricity of the projection 13 to the gear 12, the distance between the center of the gear 12 and the pivot shaft 15, the radius of the sector gear 17 and the radius of the gear 18 are so selected that the gear 18 is rotated in one direction over an angle exceeding 214° and then reversed to the original position, through the link 14 and the sector gear 17, as the gear 12 makes one rotation.

For obtaining an up and downward reciprocatory motion of the needle 2 in synchronization with the reciprocatory rotation of the gear 18, an interlocking is made such as, for example, a rotary shaft 19 which extends upwardly, FIG. 1, from the center of the gear 12, through the upper wall 1A, into connection with a driving mechanism for the needle 2.

In the sewing machine of the invention, the cloth-feeding mechanism has the following construction.

As shown in FIG. 2, a swingable lever 20 is pivoted at its one end to the lower side of the upper wall 1A of the housing, through a pivot shaft 21. An elongated slot 22 formed in the free end of the lever 20 slidably receives the projection 13 of the gear 12. A reciprocatory arm plate 24 is pivoted at its right-hand side end to the central portion of the lever 20, through a shaft 23. The arm plate 24 is supported only for left and rightward movement, at a position slightly lower than the upper wall 1A, by means of a guide 25 provided on the upper wall 1A. The arm plate 24 carries at its left-hand side end two cams which will be detailed later.

As shown in FIGS. 1 and 3, a bore is formed in the upper wall 1A of the housing 1, at the opposite side of the needle 2 to the rotating looper holder 4. The bore is adapted to be closed by a needle plate 28 which has an opening 27 for cloth-feeding teeth extending along with a needle bore 26.

A base plate 30 having cloth-feeding teeth 29 on its upper face is disposed in relation with the opening 27. The base plate 30 has a front end 30A slidably received by a slit 32 of a support plate 31 which is fixed to an extending downwardly from the upper wall 1A, so that it may be supported by the supporting plate 31.

The base plate 30 carries at its rear end 30B a downwardly extending rod 33 which is confronted by a leg 31A formed at the lower end of the supporting plate 31. A tension spring 34 is stretched between the rod 33 and the leg 31A, so as to bias the rear end 30B of the base plate 30 toward the front side and downwardly, as denoted by arrows Y and X. Consequently, the rear end 30B of the base plate 30 is brought into a resilient contact with the upper surface of the arm plate 24 and, at the same time, the rod 33 is resiliently pressed onto the side edge 24A of the arm plate 24.

The arrangement is such that the rear end 30B of the base plate 30 is displaced downwardly to make the base plate 30 inclined, so that the cloth-feeding teeth 29 are slightly retracted downwardly from the needle plate 28 and in front of the latter.

As shown in FIGS. 4 through 6, a first cam 35 for engaging and lifting the lower side of the rear portion 30B of the base plate is provided at the upper side of the left-hand side end of the arm plate 24. A second cam 36 is provided on the side surface of the rear portion of the arm plate 24. The second cam 36 is adapted to engage and bias the rod 33 rearward, when the rear end 30B of the base plate 30 comes to the position to be lifted by the first cam 35.

More specifically, referring to FIGS. 4A and 4B, over the region I of the arm plate 24 within which the left-hand side end 30C of the base plate 30 is relatively moved as a result of a rightward movement of the arm plate 24, there is formed a first cam including an inclined cam surface 35A the height of which increases toward the left-hand side end and a subsequent lift-limiting surface 35B, so as to extend, for example, vertically upwardly from the front side surface 24B of the arm plate 24. At the same time, a second cam having an inclined cam surface 36A, which projects rearwardly as it gets close to the left-hand side end, is formed on the region II of the rear side wall 24A of the arm plate 24, over which the rod 33 is moved relatively to the arm plate 24. More exactly, the second cam 36 is formed at the left-hand side portion of the region II.

Hereinafter, the construction of the horizontal rotating looper assembly will be described in detail, with specific reference to FIGS. 7 to 12 inclusive.

Referring at first to FIGS. 7 and 8, the inner peripheral wall of the rotating looper holder 4 is partially notched to form a slit 37 which provides a space for the passage of the needle 2 and for allowing a loop of thread to be formed by the needle 2. An opening 38 formed in the table surface 3 is aligned with the cloth-feeding teeth 29.

A driving plate 39 formed on the upper face of the driving plate 5 for the rotating looper 7 extends over substantially half of the circumference of the driving plate 5.

At the same time, as shown in FIGS. 9 and 10, the rotating looper 7 has an outer peripheral surface 40 over 180° which has an outer diameter similar to the inner diameter of the rotating looper holder 4.

The rotating looper 7 has a bore 41, at its central portion, for receiving a lower thread bobbin 8. A shaft or pin 42 is provided at the center of the bore 41, so as to be received by a bore of the bobbin 8.

A blade or edge 43 is formed at the front end of the aforementioned outer peripheral portion 40. Also, following the rear end of the outer peripheral portion 40, formed are engaging portions 44 and 45, for engagement with both ends of the aforementioned driving plate 39.

The upper half 40A of the outer peripheral portion 40 has a diameter slightly smaller than that of the lower half 40B. The edge 43 is positioned on the step portion 40C through which the upper and the lower halves 40A, 40B are connected. The upper half 40A and the lower half 40B are connected to the upper surface 46 and the lower surface 47, respectively, through curved surfaces continuously.

Thus, as illustrated in FIG. 11, the rotating looper 7 is disposed on the plate 5, in such a manner that the both engaging portions 44, 45 are positioned to confront respective ends of the driving plate 39.

A member 48 for preventing an entanglement of the thread consists of a base portion 48A fixed to the outside of the bottom wall of the rotating looper holder 4, a leg portion 48B upwardly bent from the base portion 48A and an end portion 48C which slightly enters the inside of the rotating looper holder 4, being bent from the upper end of the leg portion 48B and extended through the aforementioned slit 37.

The end portion 48C has a height and a length of projection into the rotating looper holder 4, which are so selected that the end portion 48C may slightly contact the surface of the upper half 40A of the outer peripheral portion 40 of the rotating looper 7, when the latter 7 has been rotated to bring the edge 43 ahead (counter-clockwise as viewed on FIG. 7) slightly beyond the position of the passage of the needle 2.

In the drawings, reference nemeral 49 denotes a power source section, e.g., a battery holder, for the motor 9.

In operation, as the motor 9 is energized, the gear 12 is rotated through the reduction gear 11 so that the projection 13 revolves along a circular path. Consequently, the rotatable link 14 is reciprocatorily swung around its pivot shaft 15, so that the driving shaft 6 for the rotating looper 7 is reciprocatorily rotated over an angle exceeding 214°, through the sector gear 17 provided at the other end of the link 14 and the gear 18. Consequently, the rotating looper 7 is rotated reciprocatorily, through its driving plate 5, in synchronization with the operation of the sewing needle 2.

Meanwhile, the swingable lever 20 is swung reciprocatorily, due to the circular revolution of the projection 13, around its pivot shaft 21, so that the arm plate 24 is moved reciprocatorily right and leftward. When the arm plate 24 commences the rightward movement as shown in FIGS. 4A and 4B, neither of the first and the second cams 35, 36 acts on the base plate 30 of the cloth-feeding teeth 29, so that the latter 29 is kept at the retracted position as shown in FIG. 3.

As the arm plate 24 is further moved rightward, the cam surface 35A of the first cam 35 comes to engage the left-hand side edge 30C of the base plate 30, so as to bias the rear end 30B of the base plate upward against the biasing force of the spring 34. Consequently, the base plate 30 is rotated, around a fulcrum constituted by the slit 32 at the front end 30A thereof, upwardly to bring the cloth-feeding teeth 29 above the surface to the needle plate 28, through the opening 27. The raised rear end 30B of the base plate 30 then engages the lift-limiting surface 35B of the first cam 35, so that the feeding teeth 29 are kept in the projected position. A still further rightward movement of the arm plate 24 brings the cam surface 36A of the second cam 36 into engagement with the rod 33 so as to bias the rod 33 rearwardly against the biasing force of the spring 34. Therefore, the base plate 30 slides on the arm plate 24 rearwardly. Since the front end 30B of the base plate 30 is still held on the lift-limiting position of the first cam 35, the cloth-feeding cam 29 are retracted rearwardly, keeping their projected posture.

In this state, the needle 2 is kept above the needle plate 28, so that the cloth mounted on the needle plate 28 is fed rearwardly by the cloth-feeding teeth 29.

As this operation is over, the arm plate 24 commences a reverse stroking, so that the base plate 30 is returned to the starting condition in the reverse order. During this reversing, the needle 2 stabs the cloth, so that the latter is prevented from being conveyed back, although the cloth-feeding teeth 29 are returned keeping their projected posture.

Thus, the sewing needle 2 makes one reciprocatory motion up and down to perform one cycle of sewing, and the rotating looper 7 makes one reciprocatory motion to feed the cloth by one pitch through the action of the cloth-feeding teeth 29.

It will be seen that the mechanism of the invention for driving the rotating looper 7 consists of a reduced number of parts, i.e., a motor 9, a gear 12 driven by the motor 9 and a rotatable link 14. Thus, the construction of the mechanism is much simplified, greatly contributing to facilitate the manufacture of the mechanism as well as to improve the durability of the mechanism.

Also, the cloth-feeding mechanism consists simply of the motor 9, gear 12, swingable lever 20, reciprocating arm plate 24, cloth-feeding teeth 29, base plate 30 and the spring 34. Since both mechanisms make a common use of the gear 12, the timed relationship between the mechanisms is quite easy to obtain, and space is greatly saved.

Needless to say, the timed operation of whole parts can be obtained by making the needle 2 to be driven by the gear 12.

In the horizontal semi-rotating looper assembly of the invention, the driving shaft 6 makes a reciprocatory rotation by a predetermined angle which is typically 214°, in synchronization with the up and downward reciprocatory motion of the sewing needle 2. Consequently, both ends of the driving plate 39 alternatingly abut the engaging portions 44, 45, within the rotating looper holder 4, so that the rotating looper 7 is reciprocatorily rotated in such a manner that its outer peripheral portion 40 passes over a part of an entire circle.

Therefore, as the needle 2 forms a loop L of the upper thread 50 within the slit 37, as shown in FIG. 12, the edge 43 of the rotating looper 7 which has been advanced in synchronization with the operation of the needle 2 comes to get into the loop L, so as to expand the latter. As the rotating looper 7 is rotated further, the loop L pass through the retaining looper 7. Meanwhile, the lower thread 52 has been extended outwardly from the bobbin 8, through a hole 51 of the rotating looper other than the outer peripheral portion 40, into engagement with the upper thread 50 to complete the sewing.

As will be seen also from FIG. 12, the end surface of the end portion 48C of the entanglement-preventing member 48 comes to slightly contact the upper half 40A of the outer peripheral portion 40, which follows the edge 43, immediately after the edge 43 passes the slit 37, and the outer peripheral portion 40 is made to move keeping a slight sliding contact with the end portion 48C. Consequently, the portion of the thread forming the loop L on the edge 43, which is to be moved along the lower side of the rotating looper 7, is prevented from being moved upwardly beyong the end portion 48C, so that the loop L is forcibly made to pass over the rotating looper 7, thereby to effectively prevent the thread from being entangled.

The functioning of the entanglement-preventing member 48 is rendered safe, by the fact that the upper half 40A of the outer peripheral portion 40 has a diameter slightly smaller than that of the lower half 40B.

The entanglement-preventing member 48 is made of, for example, a metal strip. The leg portion 48B is preferably made resilient, so that the end portion 48C may be deflected radially outwardly of the rotating looper holder 4.

In the sewing machine of the invention, when the housing 1 is made of a plastic, the rotating looper holder 4 may be formed by the same material unitarily with the housing 1. Also, the independent rotating looper 7 can easily be formed of plastic. Also, by a rounded connecting portion between the outer peripheral portion 40 and the upper and lower surfaces 46, 47, the passage of the loop L of the upper thread 50 through the rotating looper 7 is rendered smooth and safe.

In addition, partly because the number of parts is reduced, and partly because the rotating looper holder 4 is opened in the surface 3 of the table, the installation and the removal of the rotating looper 7 is considerably facilitated.

If necessary, it is possible to provide means for lifting the rotating looper 7, for an easier removal of the same, at a predetermined rotational position of the rotating looper 7.

Needless to say, the mounting of the bobbin 8 on the rotating looper 7 can simply be made by fitting the bore of the bobbin around the shaft 42.

Preferably, the bottom wall of the rotating looper 7 is bored to allow an insertion of a finger to lift up the bobbin 8 out of the rotating looper 7.

As has been described, the sewing machine in accordance with the invention is highly practical, capable of functioning without fail, easy to manufacture and less expensive, due to a much simplified structure.

What is claimed is:

1. A sewing machine having a housing; a table surface on said housing; a semi-rotating looper assembly, said semi-rotating looper assembly including a rotating looper holder having inner and outer peripheral walls, a rotating looper holder opening in said table surface of said housing, a slit formed in the inner peripheral wall of said rotating looper holder, and a rotating looper disposed in said rotating looper holder and having a bobbin holding portion and an edge; a driving mechanism for causing a partial reciprocatory rotary motion of said semi-rotating looper assembly, said driving mechanism comprising a motor secured to said housing of said sewing machine, a rotary plate adapted to be rotatively driven by said motor, a projection provided at a peripheral portion of said rotary plate, a rotatable link pivoted at its one end portion to said housing, an elongated slot formed in the other end of said rotatable link and adapted to slidably receive said projection, a sector gear formed on said one end of said rotatable link, and a driving shaft for driving the rotating looper of said semirotating looper assembly, said driving shaft having a gear engaging said sector gear; and an entanglement preventing member mounted on said machine housing and having an end extending through said slit into said rotating looper holder for a resilient contact with the outer peripheral wall of said rotating looper, said outer peripheral wall conforming in shape to said edge of said rotating looper.

* * * * *